US005121759A

United States Patent [19]

Dixit et al.

[11] Patent Number: 5,121,759

[45] Date of Patent: Jun. 16, 1992

[54] WRAPPER FOR SMOKING ARTICLE, SMOKING ARTICLE, AND METHOD OF MAKING SAME

[75] Inventors: Ajit S. Dixit; William F. Owens, Jr., both of Pisgah Forest, N.C.

[73] Assignee: P. H. Glatfelter Company, Spring Grove, Pa.

[21] Appl. No.: 677,447

[22] Filed: Mar. 29, 1991

[51] Int. Cl.[5] ..... A24D 1/02

[52] U.S. Cl. ..... 131/365; 131/334; 131/359

[58] Field of Search ..... 131/334, 359, 365

[56] References Cited

U.S. PATENT DOCUMENTS 3,744,496 7/1973 McCarty et al. .
3,831,609 8/1974 Briskin et al. ..... 131/359
3,834,398 9/1974 Briskin et al. ..... 131/359
3,908,671 9/1975 Cogbill, II ..... 131/334
4,020,850 5/1977 Cogbill, II ..... 131/334
4,231,377 11/1980 Cline et al. .
4,450,847 5/1984 Owens .
4,453,553 6/1984 Cohn ..... 131/365
4,461,311 7/1984 Mathews et al. .
4,805,644 2/1989 Hampl, Jr. et al. .
4,881,557 11/1989 Martin .
4,915,118 4/1990 Kaufman et al. .

*Primary Examiner*—V. Millin
*Assistant Examiner*—Lynne Reichard
*Attorney, Agent, or Firm*—Kerkam, Stowell, Kondracki & Clarke

[57] ABSTRACT

A wrapper for a smoking article which, when wrapped about a tobacco column, provides improved sidestream smoke reduction, improved ash formation, and acceptable mainstream smoke taste and sidestream smoke odor subjectives. These objectives are attained by forming a single cellulosic sheet containing a filler comprising basic magnesium carbonate and, where desired, a co-filler of calcium carbonate. In addition, the sheet may be treated with a burning chemical such as alkali metal salts of organic carboxylic acids, and compatible acids.

17 Claims, No Drawings

WRAPPER FOR SMOKING ARTICLE, SMOKING ARTICLE, AND METHOD OF MAKING SAME

SUMMARY OF THE INVENTION

This invention relates to smoking articles such as cigarettes, cigars, and the like, and the wrapper for the tobacco column thereof that is fabricated into a cigarette or cigar with a suitable tobacco column, which provide an acceptable burn rate, produce light-colored, well-formed ash which clings tightly without premature flaking, have significantly reduced sidestream smoke generation compared to a conventional cigarette and deliver both mainstream and sidestream smoke with acceptable taste and aroma. These desirable properties are achieved when certain defined levels of basic magnesium carbonate, by itself, or in combination with calcium carbonate co-filler, are employed to produce a base cigarette paper or cigar wrapper and this paper is subjected to treatment with burning chemicals such as alkali metal carboxylic acid salts.

BACKGROUND OF THE INVENTION

The reduced-sidestream-smoke cigarette paper patents which describe magnesium oxide/magnesium hydroxide as paper fillers, which are assigned to Olin Corporation, Ecusta Corporation, or P. H. Glatfelter Company, and which define burning chemical types and levels are U.S. Pat. Nos. 4,231,377; 4,450,847; 4,881,557; and 4,915,118. These patents disclose alkali metal acetates, citrates, nitrates, carbonates, and tartarates as burning chemical types at levels in the sheet ranging from 0.5% to 8.0%.

The Kimberly-Clark patents dealing with reduced-sidestream-smoke cigarette paper are U.S. Pat. Nos. 4,461,311 and 4,805,644. These patents disclose the sodium and potassium salts of carbonic, formic, acetic, propionic, malic, lactic, glycolic, citric, tartaric, fumaric, oxalic, malonic, nitric and phosphoric acids at levels in the sheet up to 25% by weight. U.S. Pat. No. 4,805,644 dealing with reduced-sidestream-smoke cigarette paper discloses various paper fillers with at least about 20 $M^2/g$ superficial surface area, when incorporated in paper at 5% to 50% by weight, and results in a wrapper that provides reduced sidestream smoke.

U.S. Pat. No. 3,744,496, assigned to Olin Corporation, discloses a carbon-filled paper to wrap cigarettes and/or cigars preferably used as an inner liner with regular cigarette paper or cigar wrapper as an outer wrap.

DETAILED DESCRIPTION OF THE INVENTION

It has been experimentally determined that by using basic magnesium carbonate as a filler in the furnish of the cellulosic-based paper by itself and in combination with calcium carbonate as a co-filler, provides an enhancement in sidestream smoke reduction compared to that of a conventional calcium carbonate filled cigarette paper or cigar wrapper, while maintaining acceptable ash quality, static burn rate, mainstream and sidestream taste and aroma. The truly novel finding of this invention is the reduced sidestream smoke obtained with a novel filler(s).

PARAMETERS OF THE INVENTION

Basis Weight: 25 to 100 $g/M^2$ (preferred—35 to 65 $g/M^2$)

Basic Magnesium Carbonate Content: 5% to 50% based on base weight of the paper (preferred 10% to 40%).

Calcium Carbonate Content: 0% to 40% (preferred 10% to 40%), based on the base weight of the paper.

Porosity: 3 to 25 Coresta (preferred—5 to 15 Coresta)

Basic Magnesium Carbonate Type: $xMgCO_3.yMg(OH)_2.zH_2O$ where x, y, and z are integers or fractions.

Burning Chemical: Alkali metal salts of organic carboxylic acids selected from a group consisting of citric, malic, lactic, glycolic, tartaric, fumaric, maleic, malonic, glutaric, adipic, acetic and succinic.

Addition Rate of Burning Chemical: 0.5% to 6% of the base weight of the paper.

Smoking Articles: Cigarettes, cigars and the like.

TABLE I

| Cigarette Paper | Basis Weight ($g/M^2$) | $CaCO_3$ Percent (%) | Basic Magnesium Carbonate (%) | Porosity Coresta | Filler | Static Burn Rate (mg/min) | Sidestream Reduction SSDR[1] (mg/min) |
|---|---|---|---|---|---|---|---|
| Control-Ecusta 12556 | 25.0 | 30.0 | 0.0 | 25 | $CaCO_3$ | 56.7 | 2.13 |
| Heavyweight + 1% K3 Citrate | 45.0 | 20.0 | 0.0 | 9 | $CaCO_3$ | 50.7 | 1.46 |
| LSS-Basic $MgCO_3$[2] | 45.0 | 25.0 | 15.0 | 12.0 | Martin Marietta BMC2 | 57.5 | 1.02 |
| LSS-Basic $MgCO_3$[2] | 45.0 | 25.0 | 15.0 | 17.4 | Morton Thiokol Elastocarb Heavy | 66.6 | 1.02 |
| LSS-Basic $MgCO_3$[2] | 45.0 | 25.0 | 15.0 | 16.9 | Morton Thiokol Elastocarb Light | 59.1 | 0.96 |
| LSS-Basic $MgCO_3$[2] | 45.0 | 0.0 | 30.0 | 11.2 | Alfa Magnesium Carbonate Basic | 55.1 | 1.06 |
| LSS-Basic $MgCO_3$[2] | 55.0 | 0.0 | 30.0 | 11.0 | Alfa Magnesium Carbonate Basic | 61.6 | 0.97 |
| LSS-Basic $MgCO_3$[2] | 65.0 | 0.0 | 30.0 | 11.2 | Alfa Magnesium Carbonate Basic | 62.7 | 0.85 |
| LSS-Basic $MgCO_3$[2] | 45.0 | 0.0 | 30.0 | 12.8 | Aldrich Magnesium Carbonate Basic | 53.9 | 1.06 |
| LSS-Basic $MgCO_3$[2] | 55.0 | 0.0 | 30.0 | 12.4 | Aldrich Magnesium Carbonate Basic | 54.6 | 0.95 |
| LSS-Basic $MgCO_3$[2] | 65.0 | 0.0 | 30.0 | 12.0 | Aldrich Magnesium Carbonate Basic | 56.3 | 0.87 |
| LSS-Basic $MgCO_3$[3] | 45.0 | 15.0 | 25.0 | 5.0 | Martin Marietta BMC2 | 55.7 | 0.92 |
| LSS-Basic $MgCO_3$[2] | 45.0 | 15.0 | 25.0 | 7.0 | Morton Thiokol Elastocarb Light | 55.5 | 0.94 |
| LSS-Basic $MgCO_3$[2] | 45.0 | 15.0 | 25.0 | 9.4 | Morton Thiokol Elastocarb Heavy | 58.9 | 0.89 |
| LSS-Basic $MgCO_3$[4] | 45.0 | 15.0 | 25.0 | 5.0 | Martin Marietta BMC2 | 58.0 | 0.87 |
| LSS-Basic $MgCO_3$[4] | 45.0 | 0.0 | 40.0 | 7.5 | Martin Marietta BMC2 | 44.2 | 0.72 |

TABLE I-continued

| Cigarette Paper | Basis Weight ($g/M^2$) | $CaCO_3$ Percent (%) | Basic Magnesium Carbonate (%) | Porosity Coresta | Filler | Static Burn Rate (mg/min) | SSDR[1] (mg/min) |
|---|---|---|---|---|---|---|---|
| | | | Sidestream Reduction | | | | |
| LSS-Basic $MgCO_3$[2] | 45.0 | 15.0 | 25.0 | 12.4 | Marine Magnesium Magcarb L | 64.1 | 0.89 |

[1]SSDR = Sidestream Delivery Rate (mg/min)
[2]Burning Chemical Content - 5.1% Potassium Acetate
[3]Burning Chemical Content - 5.1% Potassium Acetate + 6% Sucrose
[4]Burning Chemical Content - 5.6% Potassium Citrate + 2% Citric Acid + 6% Sucrose Comments on Table I It can be concluded from Table I above that all of the basic magnesium carbonates of various compositions evaluated are effective in significantly reducing the sidestream delivery rate in combination with calcium carbonate as a co-filler, or as a filler by itself, in paper. Burn rate control depends upon buring chemical type and level, basis weight, sheet porosity, filler type and level, sheet density and basic magnesium carbonate type and level in paper.

TABLE II

Ash Properties
Test cigarettes - Commercial 100 mm "LIGHTS" brand with standard paper removed and replaced with the experimental reduced sidestream smoke cigarette paper.

| Cigarette Paper | Static Ash | Puffed Ash |
|---|---|---|
| Control[1] | Tight Shrinkage<br>Light Grey<br>No Flake Fall Off<br>Solid Sheath | Tight Shrinkage<br>Light Grey<br>No Flake Fall Off<br>Small Adhering Flakes |
| 45 $g/M^2$,[2]<br>Basic Magnesium<br>Carbonate = 30% | Some Shrinkage<br>Light Grey<br>Loose Flakes<br>Small Flakes | Tight Shrinkage<br>Light Grey<br>Few Loose Flakes<br>Small Flakes |
| 45 $g/M^2$,[3]<br>Basic Magnesium<br>Carbonate - 25%<br>Calcium<br>Carbonate - 10% | Tight Shrinkage<br>Light Grey<br>Few Loose Flakes<br>Small Flakes | Tight Shrinkage<br>Light Grey<br>No Flake Fall Off<br>Solid Sheath |

[1]Ecusta 12556 cigarette paper: 30% Calcium Carbonate; 25 Coresta Porosity; 25 $g/M^2$; 0.55 Citrate Burning Chemicals
[2]30% Alfa Basic Magnesium Carbonate; 11.2 Coresta Porosity; 45 $g/M^2$; 5.1% Potassium Acetate Burning Chemical
[3]25% Morton Thiokol Elastocarb Light Basic Magnesium Carbonate; 15% Calcium Carbonate Filler; 7 Coresta Porosity; 45 $g/M^2$; 5.1% Potassium Acetate Burning Chemical Comments on Table II The ash properties results stated in Table II indicate that combination of basic magnesium carbonate/calcium carbonate-filled cellulosic fiber paper is giving ash properties very similar to that obtained with regular cigarette paper (control) with no significant differences observed between these two papers.

TABLE III

Particle Size and Surface Area Characteristics of Basic Magnesium Carbonate Fillers

| Filler | Vendor | Chemical Composition | Particle[1] Size (um) Number Median | Number Mode | Volume Median | Volume Mode | Surface[2] Area ($M^2/g$) |
|---|---|---|---|---|---|---|---|
| BMC-2 | Martin Marietta | Basic $MgCO_3$ | 1.47 | 1.24 | 4.83 | 1.79 | 11.04 |
| Elastocarb Tech heavy | Morton Thiokol | Basic $MgCO_3$ | 2.51 | 1.41 | 10.01 | 9.26 | 16.90 |
| Elastocarb Tech Light | Morton Thiokol | Basic $MgCO_3$ | 2.04 | 1.28 | 6.37 | 7.17 | 19.01 |
| Magcarb L | Marine Magnesium | Basic $MgCO_3$ | 1.74 | 1.54 | 6.19 | 9.88 | 31.98 |

[1]Particle size measured by Coulter Multisizer instrument
[2]Surface area by B.E.T. method Comments on Table III The basic magnesium carbonate filler characteristics are presented in terms of particle size and surface area. Based on results presented in Table I on sidestream delivery rate, it is conclusive that filler surface area does not directly correlate with sidestream reduction efficiency. As presented in Table I and III, above, surface area of basic magnesium carbonate fillers ranging from 11 $M^2/g$ to 32 $M^2/g$ was evaluated and all fillers were determined to be equivalent in their sidestream reduction activity. This observation is markedly contrary to the claim of Hampl, et al. (U.S. Pat. No. 4,805,644) that as filler surface area increases, the sidestream smoke reduction (%) increases.

We claim:

1. A wrapper for smoking articles such as cigarettes, cigars, and the like, comprising a cellulosic fiber sheet containing, as a filler, basic magnesium carbonate.

2. The wrapper, as defined in claim 1, wherein the content of the basic magnesium carbonate is from 5.0% to 50% and further comprising 0% to 40% of a co-filler of calcium carbonate from.

3. The wrapper, as defined in claim 2, wherein the content of basic magnesium carbonate is from 10% to 40% and the content of the calcium carbonate is from 10% to 40%.

4. The wrapper, as defined in claim 3, further including a burning chemical, wherein the addition rate of the burning chemical is 0.5% to 6% of the base weight of the paper.

5. The wrapper, as defined in claim 4, further including 0.5% to 6% alkali metal slats of organic carboxylic acids selected from the group consisting of citric, malic, lactic, glycolic, tartaric, fumaric, maleic, malonic, glutaric, adipic, acetic, and succinic.

6. The wrapper, as defined in claim 3, further including 0.5% to 6% of an appropriately compatible acid.

7. A smoking article such as cigarettes, cigars, and the like, comprising a tobacco charge and a wrapper comprising a cellulosic fiber sheet containing, as a filler, basic magnesium carbonate.

8. The smoking article, as defined in claim 7, wherein the content of the basic magnesium carbonate is from 5.0% to 50% and further including 0% to 40% of a co-filler of calcium carbonate from.

9. The smoking article, as defined in claim 8, wherein the content of basic magnesium carbonate is from 10% to 40% and the content of the calcium carbonate is from 10% to 40%.

10. The smoking article, as defined in claim 9, further including a burning chemical wherein the addition rate of the burning chemical is 0.5% to 6% of the base weight of the paper.

11. The smoking article, as defined in claim 10, further including 0.5% to 6% alkali metal salts of organic carboxylic acids selected from the group consisting of citric, malic, lactic, glycolic, tartaric, fumaric, maleic, malonic, glutaric, adipic, acetic, and succinic.

12. The smoking article, as defined in claim 9, further including 0.5% to 6% of an appropriately compatible acid.

13. A method for reducing the visible sidestream smoke emanating from a smoking article and improving the ash properties comprising wrapping a tobacco charge in a combustible cellulosic sheet containing, as a filler, basic magnesium carbonate.

14. The method, as defined in claim 13, wherein the content of basic magnesium carbonate is from 5.0% to 50% and further comprising 0% to 40% a co-filler of calcium carbonate.

15. The method, as defined in claim 13, wherein the content of basic magnesium carbonate is from 10% to 40% and the content of the calcium carbonate is from 10% to 40%.

16. The method, as defined in claim 15, further including 0.5% to 6% alkali metal salts of organic carboxylic acids selected from the group consisting of citric, malic, lactic, glycolic, tartaric, fumaric, maleic, malonic, glutaric, adipic, acetic, and succinic.

17. The method, as defined in claim 15, further including 0.5% to 6% of an appropriately compatible acid.

* * * * *

UNITED STATES PATENT AND TRADEMARK OFFICE

CERTIFICATE OF CORRECTION

PATENT NO. : 5,121,759

DATED : June 16 1992

INVENTOR(S) : DIXIT et al.

It is certified that error appears in the above-identified patent and that said Letters Patent is hereby corrected as shown below:

Column 4, Claim 2, line 4, delete "from".

Column 4, Claim 5, line 2, "slats" should be -- salts --.

Column 4, Claim 8, line 4, delete "from".

Column 6, Claim 14, line 3, after "40%" insert -- of --.

Signed and Sealed this

Twenty-fourth Day of August, 1993

Bruce Lehman

*Attest:*

BRUCE LEHMAN

*Attesting Officer*

*Commissioner of Patents and Trademarks*